United States Patent [19]

Novatny

[11] 4,158,410

[45] Jun. 19, 1979

[54] CONTAINER BLANK INCLUDING BINDING STRAP TABS

[75] Inventor: Donald F. Novatny, Marion, Ohio

[73] Assignee: Boise Cascade Corporation, Boise, Id.

[21] Appl. No.: 886,452

[22] Filed: Mar. 14, 1978

[51] Int. Cl.[2] ..... B65D 85/54

[52] U.S. Cl. ..... 206/527; 229/DIG. 8; 206/451; 206/597

[58] Field of Search ..... 229/DIG. 8, 37 R, 40; 217/43 A; 108/55.5; 206/527, 83.5, 451, 597

[56] References Cited

U.S. PATENT DOCUMENTS

| | | | |
|---|---|---|---|
| 3,132,744 | 5/1964 | Scharf | 206/210 |
| 3,263,896 | 8/1966 | Woolsey | 229/37 R |
| 3,344,917 | 10/1967 | Raffet | 206/451 |
| 3,606,135 | 9/1971 | Rosenburg, Jr. | 229/37 R |
| 3,923,236 | 12/1975 | Calvert | 229/40 |
| 3,949,932 | 4/1976 | Shore | 229/40 |

*Primary Examiner*—Herbert F. Ross
*Attorney, Agent, or Firm*—Lawrence E. Laubscher

[57] ABSTRACT

A unitary blank for forming a packaging container for a heavy article such as a motor is disclosed, the blank including opposed vertical side and end wall panels, and top and bottom flaps connected with each of the panels, respectively, characterized by the provision in the fold lines between each of a pair of opposed panels and at least one of the flaps connected thereto an H-shaped cut, which cut straddles the fold line and defines a pair of opposed binding tabs generally facing the fold line, whereby when the flap is folded to a horizontal position and the tabs are foldably displaced inwardly, a recess is formed in the edge between the panel and the associated flap for receiving a binding strap arranged circumferentially about the container. Preferably, each H-shaped cut is so arranged relative to the fold line that the binding tabs are of unequal length, so that when they are foldably displaced inwardly, the adjacent edges of the binding tabs overlap, whereby the binding tabs serve both to stabilize the article in the container, and to protect the article against damage by the binding tab. The container blank, which is preferably formed of corrugated fibrous material, may include precrushed portions arranged beneath the binding strap.

7 Claims, 8 Drawing Figures

Fig. 1
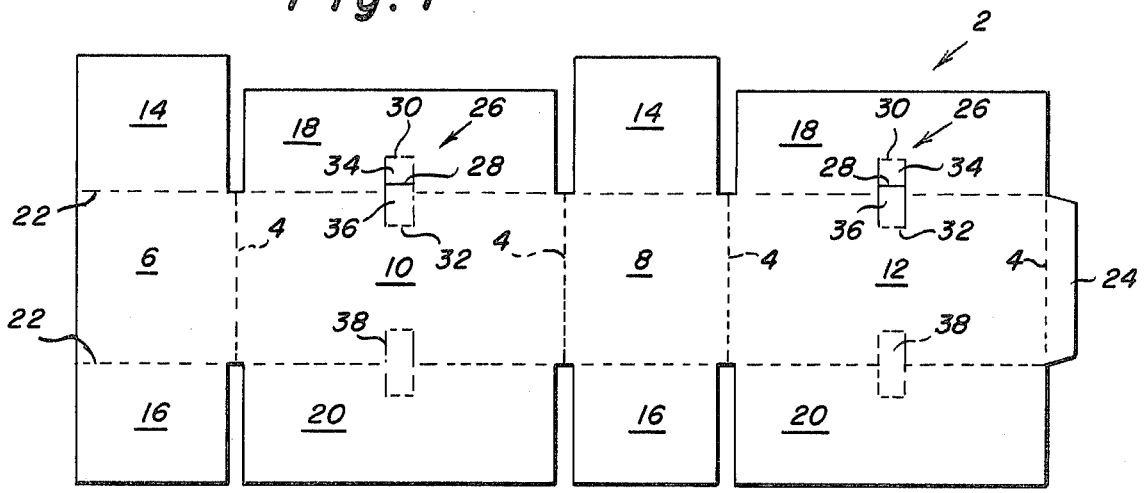
Fig. 2
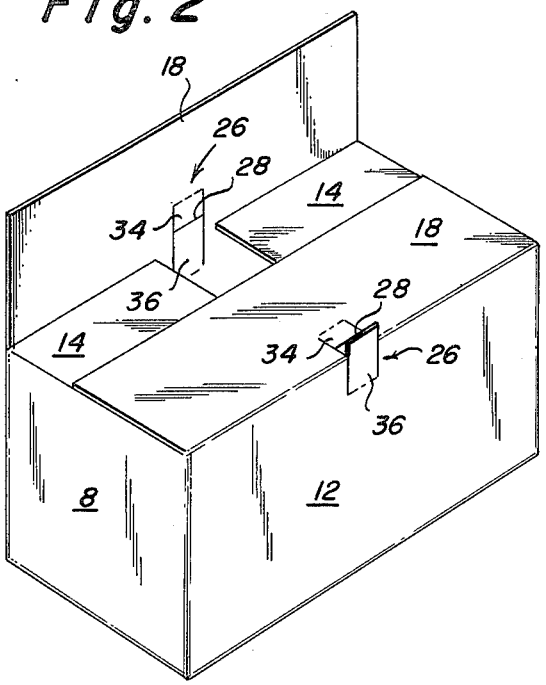
Fig. 3
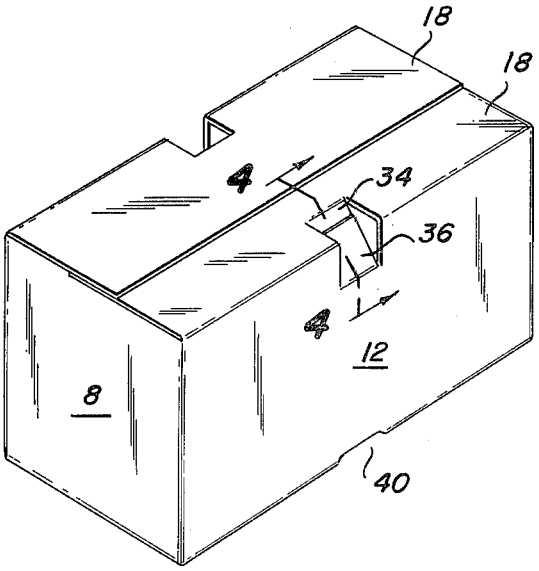
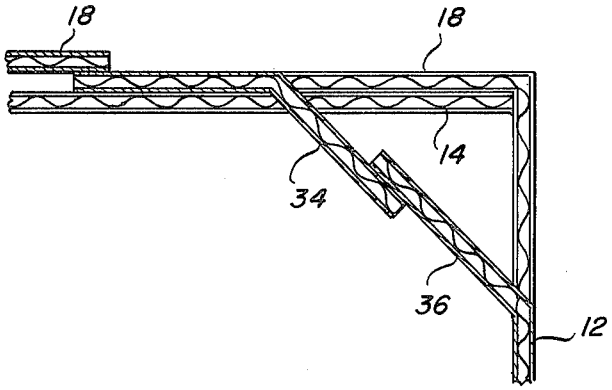
Fig. 4

CONTAINER BLANK INCLUDING BINDING STRAP TABS

BRIEF DESCRIPTION OF THE PRIOR ART

Corrugated packaging containers bound by binding straps are well known in the patented prior art, as evidenced, for example, by the patents to Mangini et al U.S. Pat. No. 3,954,219 and Welshenback U.S. Pat. No. 2,833,456. In addition, the prior art discloses the provision of H-shaped cuts in display containers, as shown by the patent to Crane, Jr., U.S. Pat. No. 2,748,927.

While the prior containers normally operate quite satisfactorily, they have proven unreliable for securely packaging heavy articles without the use of an internal binding. Furthermore, no provision is made in the edges of the prior containers for receiving a binding strap to close the container and to retain the packaged article in an immovable position within the container.

The present invention was developed to provide an improved container construction in which H-shaped cuts which define a pair of opposing deformable binding tabs are provided in a pair of opposed edges of the container. A binding strap is wrapped circumferentially around the container above the H-shaped cuts, and upon tightening of the strap, the tabs are deformed inwardly to define a recess for receiving the binding strap, and the container is closed to securely hold a packaged article in an immovable condition.

SUMMARY OF THE INVENTION

The primary object of the present invention is to provide a container blank including a plurality of vertical fold lines which define pairs of opposed side and end wall panels, a plurality of top and bottom flaps connected with the upper and lower edges of the panels by horizontal fold lines, and H-shaped cuts arranged in straddling relation across the horizontal fold lines associated with an opposed pair of panels and the flaps secured thereto, respectively, said H-shaped cuts defining opposed binding strap tabs that are foldable inwardly within the container to define in the corresponding container edge a recess for receiving a circumferentially arranged binding strap or band. The H-shaped cuts extend vertically across the associated horizontal fold line and the bridging portion of the cut is horizontal, parallel with, and spaced from the associated horizontal fold line, whereby the opposed binding tabs are of unequal length. When a binding strap is wrapped circumferentially around the container above the H-cuts and is tightened, the binding tabs are deflected inwardly in overlapping relation to provide a binding strap recess in the edges of the container. The overlapping tabs are also adapted to engage an object packaged within the container to maintain the object immobile and also to protect the object against damage by the binding strap. The container is particularly suitable for packaging a heavy article, such as an electric motor.

In accordance with another object of the invention, portions of the container adjacent the binding-strap-receiving recesses may be crushed during the blank forming operation, whereby when the binding strap is tightened, the walls of the container cooperate with the binding strap, the recesses, and the crushed portions to securely hold the article in an immovable condition.

BRIEF DESCRIPTION OF THE DRAWING

Other objects and advantages of the invention will become apparent from a study of the following specification when viewed in the light of the accompanying drawing, in which:

FIG. 1 is a plan view of the container blank;

FIGS. 2 and 3 are perspective views illustrating the assembly of a container from the blank of FIG. 1;

FIG. 4 is a detailed sectional view illustrating the deformable binding tabs;

DETAILED DESCRIPTION

Figure 5:
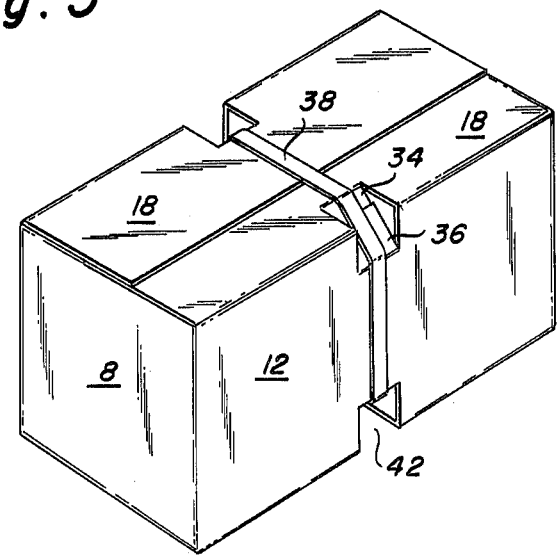
FIG. 5 is a perspective view of a modification of the container of FIG. 3, including a binding strap.

Referring now more particularly to FIG. 1, the rectangular container blank 2 includes a plurality of vertical fold lines 4 which define opposed pairs of end wall panels 6, 8 and side wall panels 10,12. End wall top and bottom flaps 14,16 and side wall top and bottom flaps 18,20 are connected with the upper and lower edges of the end and side wall panels, respectively, by a pair of horizontal fold lines 22. A closure flap 24 is connected with one edge of the side wall panel 12 along the vertical fold line 4.

Each side wall panel 10,12 includes an H-shaped cut 26 the parallel portions of which extend in straddling relation across the upper horizontal fold line 22 into the associated top flap 18. The bridging portion 28 of each of the H-shaped cuts is arranged parallel with and spaced from the horizontal fold line 22. The H-shaped cuts have horizontal fold lines 30,32 arranged between the ends of the parallel cuts of the H-shaped cuts to define a pair of opposing deformable binding tabs 34,36, the lower binding tab 36 having a greater length than the upper binding tab 34.

To form the packaging container, the blank is initially folded about the vertical fold lines 4 into a tubular configuration, the closure flap 24 being secured to the free edge of the opposite end wall by any suitable means such as a layer of adhesive. The end wall bottom flaps 16 are folded upwardly about the lower horizontal fold line 22 and the side wall bottom flaps 20 are folded upwardly about the lower horizontal fold line 22 to form the horizontal bottom wall of the container.

As shown more particularly in FIGS. 2 and 3, the end wall top flaps 14 are folded downwardly about the upper horizontal fold line 22 and the side wall top flaps 18 are folded downwardly about the upper horizontal fold line 22 to form the horizontal top wall of the container. The H-cuts 26 are arranged in the upper edges of the container between the side wall panels and top wall.

A binding strap 38 (FIG. 5) is used to close the container. The binding strap may comprise a band formed of metal or of a suitable synthetic plastic material, such as polyethylene. The strap is wrapped circumferentially around the container above the H-shaped cuts 26. When the binding strap is tightened, the binding tabs are deflected inwardly and the container is secured in a closed condition. FIG. 3 illustrates the closed container without the binding strap.

The overlapping relation of the binding tabs is shown more particularly in FIG. 4. When the binding strap is tightened, the shorter upper binding tab 34 is deflected inwardly and the longer lower binding tab 36 is also deflected inwardly. The tabs overlap each other as a result of the spacing of the bridging portion 28 of the H-shaped cut from the horizontal fold line 22. It is readily apparent that the recess formed by the deflected binding tabs prevent the binding strap from sliding along the edge of the container in order to maintain the container in a closed condition. Furthermore, the recesses in the edge of the container reduce the friction of the tightened binding strap against the edge of the container. Thus, destruction of the container edge is prevented while protection to the packaged article is maintained.

The container blank 2 of FIG. 1 may be modified in the area 38 of the side wall panels 10,12 and associated bottom flaps 20 according to the type of article being packaged. If an electric motor having a base is to be packaged, for example, the area 38 may be crushed prior to folding of the blank. The crushed area extends vertically across the horizontal fold line 22 into the side wall panels 10,12 and the bottom flaps 20 and forms an indented area 40 in the lower edges of the container opposite said H-shaped cuts as shown in FIG. 3. The indented area 40 receives the binding strap 22 to prevent lateral displacement of the strap during handling of the container.

In the alternative, the area 38 may be provided with H-shaped cuts similar to the cuts 26, the parallel portions of which extend vertically across the horizontal fold line 22 into the side wall panels 10,12 and the bottom flaps 20. The bridging portion of the additional cuts is horizontal, parallel with, and spaced from the horizontal fold line 22 to define opposing binding tabs. As with the cuts 26, when a binding strap is placed over the H-cuts and subsequently tightened, the tabs are deflected inwardly to define a recess 42 (FIG. 5) for receiving the binding strap 22 in the bottom edges of the container.

The container blank of FIG. 1 may be modified further by providing additional H-shaped cuts between the side wall panels and associated top and bottom wall flaps whereby a plurality of parallel binding straps may be circumferentially wrapped around the container. In addition, H-shaped cuts may be provided between the end wall panels and associated top and bottom wall flaps whereby a binding strap may be wrapped circumferentially around the container, the second binding strap traversing the first binding strap.

Figure 6:
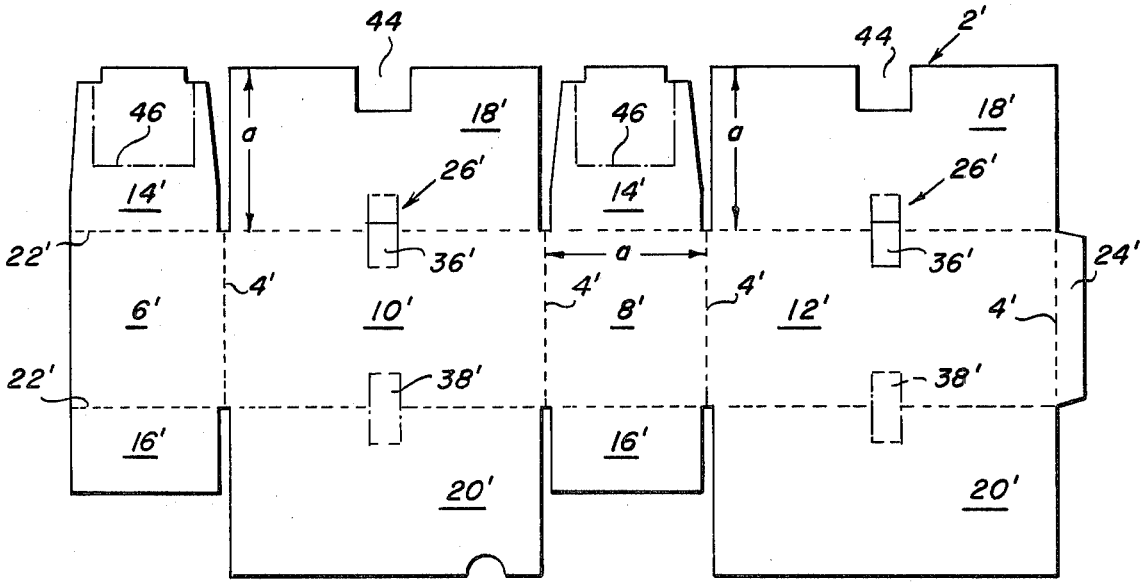
FIG. 6 is a plan view of the second embodiment of the container blank.
Figure 7:
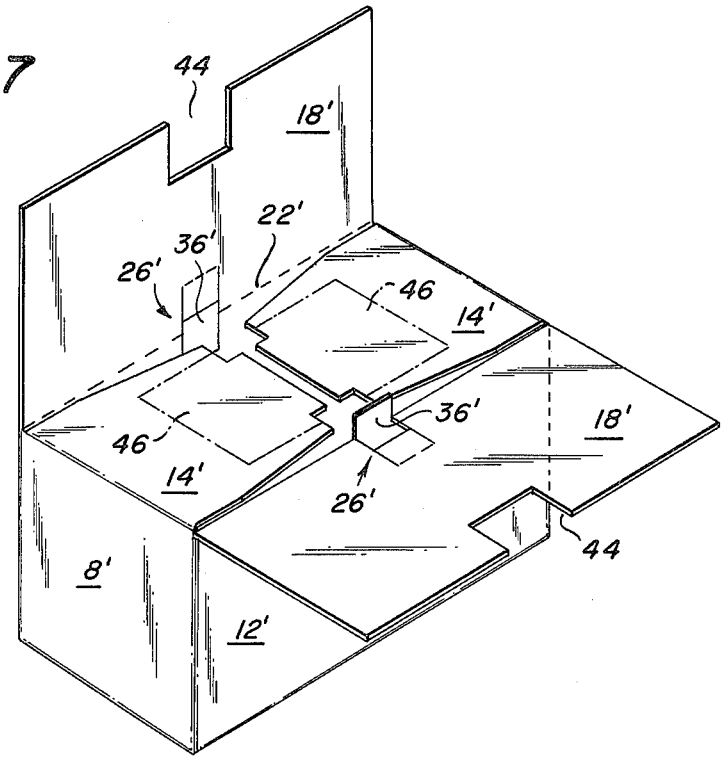
FIGS. 7 and 8 are perspective views illustrating the assembly of a container from the blank of FIG. 6.
Figure 8:
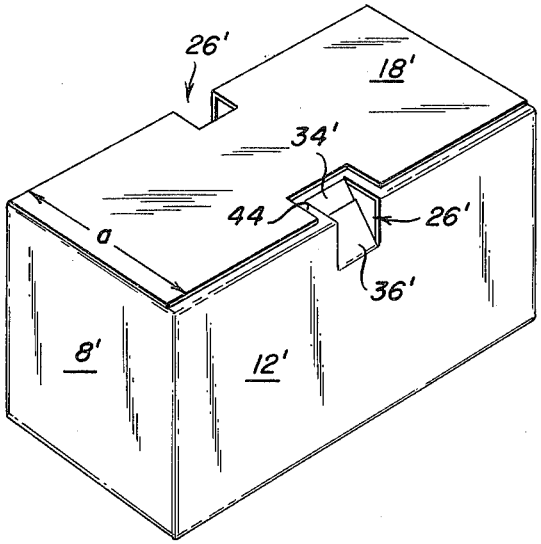

A second embodiment of the container blank is shown in FIG. 6. The blank of the second embodiment is characterized by the sidewall top flaps 18' having a vertical dimension (a) generally equal to the width of the end wall panels 6',8' whereby upon folding of the blank as shown in FIGS. 7 and 8, may also side wall top flaps 18' extend completely across the top of the folded container. Each side wall top flap includes a recess 44 in the free edge opposite the H-shaped cut 26', whereby the recess 44 is arranged opposite the H-shaped cut 26' contained in the opposite side wall top flap, the recess serving to receive a binding strap. The areas 38' may be crushed or may contain H-shaped cuts as in the blank of FIG. 1. In addition, the area designated by the reference numeral 46 in the end wall top flaps 14' also be crushed. In the packaging of a heavy article such as an electric motor, the crushed portions 46 of the end wall top flaps will be folded into contiguous relation with the article whereby upon tightening of the binding strap, the end wall top flaps are pressed against the article to securely hold it in an immovable condition. In this manner, no inner packaging of any type is required.

While in accordance with the provisions of the Patent Statutes, the preferred form and embodiment of the invention has been illustrated and described, it will be apparent to those skilled in the art that other changes and modifications may be made without deviating from the inventive concepts set forth above.

What is claimed is:

1. A unitary blank for forming a container for an article, comprising (a) a generally rectangular blank containing a plurality of vertical fold lines which define pairs of opposed side and end wall panels;

(b) said blank including a plurality of top and bottom flaps connected with the upper and lower edges of each of said panels by horizontal fold lines, respectively;

(c) the horizontal fold line between one of said panels and the associated top flap connected thereto containing a first H-shaped cut, the horizontal fold line between the panel opposite said one panel and the top flap connected thereto containing a second H-shaped cut opposite and corresponding with the first H-shaped cut, the vertical parallel arms of each of said cuts extending from said panels across the associated horizontal fold line and into the associated top flaps, thereby to define a pair of opposed binding tabs;

(d) the height of each of the top flaps which contains portions of the H-shaped cuts generally equalling the width of the remaining pair of panels, each of said cut-containing top flaps containing in its free upper edge a recess opposite said H-shaped cut, whereby when the panels are folded to define a tubular configuration, said recess is arranged opposite the H-shaped cut in said opposite panel, and when the flaps are folded to horizontal positions closing the upper and lower ends of the tube, the binding tabs may be folded inwardly to define in the associated edge a recess for receiving a circumferentially arranged binding strap.

2. A unitary blank for forming a container for an article, comprising (a) a generally rectangular blank containing a plurality of vertical fold lines which define pairs of opposed side and end wall panels;

(b) said blank including a plurality of top and bottom flaps connected with the upper and lower edges of each of said panels by horizontal fold lines, respectively;

(c) the horizontal fold line between at least one of said panels and the associated flap connected thereto containing an H-shaped cut the vertical parallel arms of which extend from said panel across the horizontal fold line and into the associated flap, the transverse portion of said cut being spaced from the associated fold line, thereby to define a pair of opposed binding tabs of unequal length, whereby when the panels are folded to define a tubular configuration and the flaps are folded to horizontal positions closing the upper and lower ends of the tube, the binding tabs may be folded inwardly toward positions in which the adjacent edges thereof overlap for protecting an article packaged within the container and for defining in the associated container edge a recess for receiving a circumferentially arranged binding strap.

3. A blank as defined in claim 2, wherein the horizontal fold line between the panel opposite said one panel and the flap connected thereto also contains a corresponding H-shaped cut opposite the first H-shaped cut, said H-shaped cuts being contained in the horizontal fold lines connecting said top flaps with said panels.

4. A container blank as defined in claim 2, wherein the horizontal fold line between said one panel and the other flap connected thereto contains a second H-shaped cut opposite said first cut, the parallel portions of said second cut extending vertically across the associated horizontal fold line, whereby a second binding strap receiving recess is defined at the other end of the container.

5. A container blank as defined in claim 3, wherein said cut-containing pair of opposed panels are provided at their lower ends with second H-shaped cuts that extend from said panels and across the lower horizontal fold lines into the associated bottom flaps, thereby to define a pair of binding strap receiving recesses in the bottom edges of the container.

6. A container blank as defined in claim 2, and further including means connecting together the adjacent free edges of a pair of said panels when said panels are folded into the tubular configuration, and at least one binding strap mounted circumferentially about the container when the flaps are folded to their horizontal positions, said binding strap extending within said recess to maintain the binding tabs in their folded overlapping condition.

7. Apparatus as defined in claim 6, wherein portions of the blank beneath said binding strap are precrushed during the blank forming operation.

* * * * *